US007191758B2

(12) United States Patent
Umezu

(10) Patent No.: US 7,191,758 B2
(45) Date of Patent: Mar. 20, 2007

(54) ENGINE CONTROL DEVICE OF CONSTRUCTION MACHINERY

(75) Inventor: Yoshiyasu Umezu, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 29 days.

(21) Appl. No.: 10/544,225

(22) PCT Filed: Dec. 25, 2003

(86) PCT No.: PCT/JP03/16685

§ 371 (c)(1),
(2), (4) Date: Aug. 2, 2005

(87) PCT Pub. No.: WO2004/070179

PCT Pub. Date: Aug. 19, 2004

(65) Prior Publication Data

US 2006/0137652 A1 Jun. 29, 2006

(30) Foreign Application Priority Data

Feb. 6, 2003 (JP) ..... 2003-029309

(51) Int. Cl.
*F02B 77/08* (2006.01)

(52) U.S. Cl. ..... 123/397; 123/198 D; 123/198 DB; 123/198 DC

(58) Field of Classification Search ..... 123/397, 123/198 D, 198 DB, 198 DC
See application file for complete search history.

(56) References Cited

U.S. PATENT DOCUMENTS

| | | | | |
|---|---|---|---|---|
| 4,267,807 | A * | 5/1981 | Ashfield | 123/198 D |
| 4,574,752 | A * | 3/1986 | Reichert et al. | 123/198 DB |
| 5,033,428 | A * | 7/1991 | Sasaki | 123/198 D |
| 5,353,762 | A * | 10/1994 | Dykstra et al. | 123/352 |
| 6,474,300 | B1 * | 11/2002 | Steffen | 123/198 D |
| 6,961,654 | B2 * | 11/2005 | Boggs et al. | 123/198 DB |
| 7,136,742 | B2 * | 11/2006 | Andersson et al. | 123/198 DC |

FOREIGN PATENT DOCUMENTS

| | | |
|---|---|---|
| JP | 9-49446 | 2/1997 |
| JP | 2000-96627 | 4/2000 |
| JP | 2001-41069 | 2/2001 |

* cited by examiner

*Primary Examiner*—Erick Solis
(74) *Attorney, Agent, or Firm*—Oblon, Spivak, McClelland, Maier & Neustadt, P.C.

(57) ABSTRACT

A controller of a engine control device according to the present invention is configured to activate an automatic stop control of an engine when there is met a condition that an open state of a gate lever is detected by a limit switch and a rotation speed of the engine detected by a rotation sensor is equal to or lower than a predetermined engine stop rotational speed.

8 Claims, 6 Drawing Sheets

ENGINE CONTROL DEVICE OF CONSTRUCTION MACHINERY

TECHNICAL FIELD

The present invention relates to an engine control device for a construction machine.

BACKGROUND ART

Japanese Patent Laid-Open Nos. 2000-96627 and 2001-41069 disclose construction machines provided with an automatic stop function which automatically stops an engine upon there being met a predetermined automatic stop condition (such as a condition that a gate lever adapted to open/close a gateway for an operator is opened, and a lever adapted to operate a work actuator is not being operated).

However, upon an automatic stop being activated while a throttle lever is maintained to "High" (high rotational speed) on these construction machines, the engine is stopped while the temperature thereof is still high. As a result, if the engine is equipped with a turbine supercharger, there may occur troubles such as seizures of bearings used for a turbine.

Moreover, upon the engine being started, if the throttle lever is maintained to "High", the engine immediately starts at a high rotational speed. As a result, the life of the engine may be reduced as well as a load being applied to the engine due to oil film ruptures and the like.

DISCLOSURE OF THE INVENTION

It is an object of the present invention to provide an engine control device for a construction machine which can prevent a construction machine provided with the automatic stop function from stopping while an engine thereof is running at a high rotational speed, thereby eliminating troubles of the engine, and extending the life thereof.

The present invention provides an engine control device for a construction machine including an engine, engine rotational speed instructing means for instructing a rotational speed of the engine, a gate lever for opening and closing a gateway for an operator, a gate lever position detecting means for detecting an open or closed state of the gate lever, an engine rotational speed detecting means for detecting the rotational speed of the engine, and engine control means, where the engine control means is configured to automatically stop the engine when there is met a condition that the open state of the gate lever is detected by the gate lever position detecting means, and the rotation speed of the engine detected by the engine rotational speed detecting means is equal to or lower than a predetermined engine stop rotational speed.

With this configuration, upon there being met the condition that the open state of the gate lever is detected by the gate lever position detecting means, and the condition that the rotation speed of the engine detected by the engine rotational speed detecting means is equal to or lower than the predetermined engine stop rotational speed, and if the condition is met, the engine control means automatically stops the engine. As a result, the engine is stopped after reaching a low rotational speed equal to or lower than the engine stop rotational speed.

It is thus possible to prevent the construction machine provided with the automatic stop function from stopping while the engine thereof is running at a high rotational speed, thereby eliminating troubles of the engine, and extending the life thereof. Moreover, since the engine is stopped while running at a low rotational speed, upon the engine being equipped with a turbine supercharger, for example, there is no fear for possible troubles such as seizures of turbine bearings used for a turbine. Further, after the stop of the engine, since the position instructed by the engine rotational speed instructing means is on a low rotation speed side, and the engine is always started at a low rotational speed according to the instruction upon an engine start, the engine is sufficiently lubricated. Therefore there is no fear for possible oil film ruptures and the like.

The engine rotational speed detecting means may be a rotation sensor for directly detecting the rotational speed of the engine. With this configuration, the automatic stop of the engine is precisely determined based upon the actual engine rotational speed.

Moreover, a throttle lever operated by the operator may be provided as the engine rotational speed instructing means, and an operation amount detecting sensor for detecting an operation position of the throttle lever may be provided as the engine rotational speed detecting means, and the engine control means may be configured to obtain the engine rotational speed based upon the operation position of the throttle lever detected by the operation amount detecting sensor thereby determining whether the condition is met or not. With this configuration, it is possible to determine whether the engine can be automatically stopped only according to the operation position of the throttle lever. Consequently, it is not necessary to detect the actual engine rotational speed, and the device configuration is simplified accordingly.

A deceleration switch for instructing a rotational speed equal to or lower than the engine stop rotational speed (low rotational speed) may be provided, and the engine control means may be configured to regard that the engine rotational speed detecting means detects the engine rotational speed equal to or lower than the engine stop rotational speed upon the deceleration switch being operated, and thus to determine that the condition is met. With this configuration, since the low rotational speed equal to or lower than the engine stop rotational speed is instructed by simply operating the deceleration switch, the operation thereof is simplified.

There may be provided notifying means for, upon the condition being not met, issuing a notice that the condition is not met. With this configuration, the operator realizes that the engine will not be automatically stopped due to the condition being not met based upon the notice, and thus is prompted to take proper measures.

The engine control means may be configured to wait for a rotational speed decelerating instruction by the engine rotational speed instructing means after the notice issued by the notifying means. Upon the rotational speed decelerating instruction being issued, and the rotational speed then decelerating to or below the predetermined engine rotational speed, the engine is automatically stopped. With this configuration, even if the operator does not realize the notice, and turns off a key by mistake, there is no fear that the engine is manually stopped.

Moreover, the present invention provides an engine control device for a construction machine including an engine, a gate lever for opening and closing a gateway for an operator, and engine rotational speed detecting means for detecting a rotational speed of the engine, including alarming means for comparing the rotational speed detected by the engine rotational speed detecting means and a predetermined engine stop rotational speed with each other upon the gate lever being opened, and outputting an alarm upon the rotational speed being equal to or more than the engine stop rotational speed.

With this configuration, upon the gate lever being opened, and the rotational speed being equal to or more than the engine stop rotational speed, the alarm is output. Consequently, it is possible to notify the operator that the condition is not met for stopping the engine, namely, the present state does not allow a safe engine stop.

BEST MODE FOR CARRYING OUT THE INVENTION

A description will now be given of a few embodiments of the present invention with reference to drawings.

(a) First Embodiment

Figure 1:
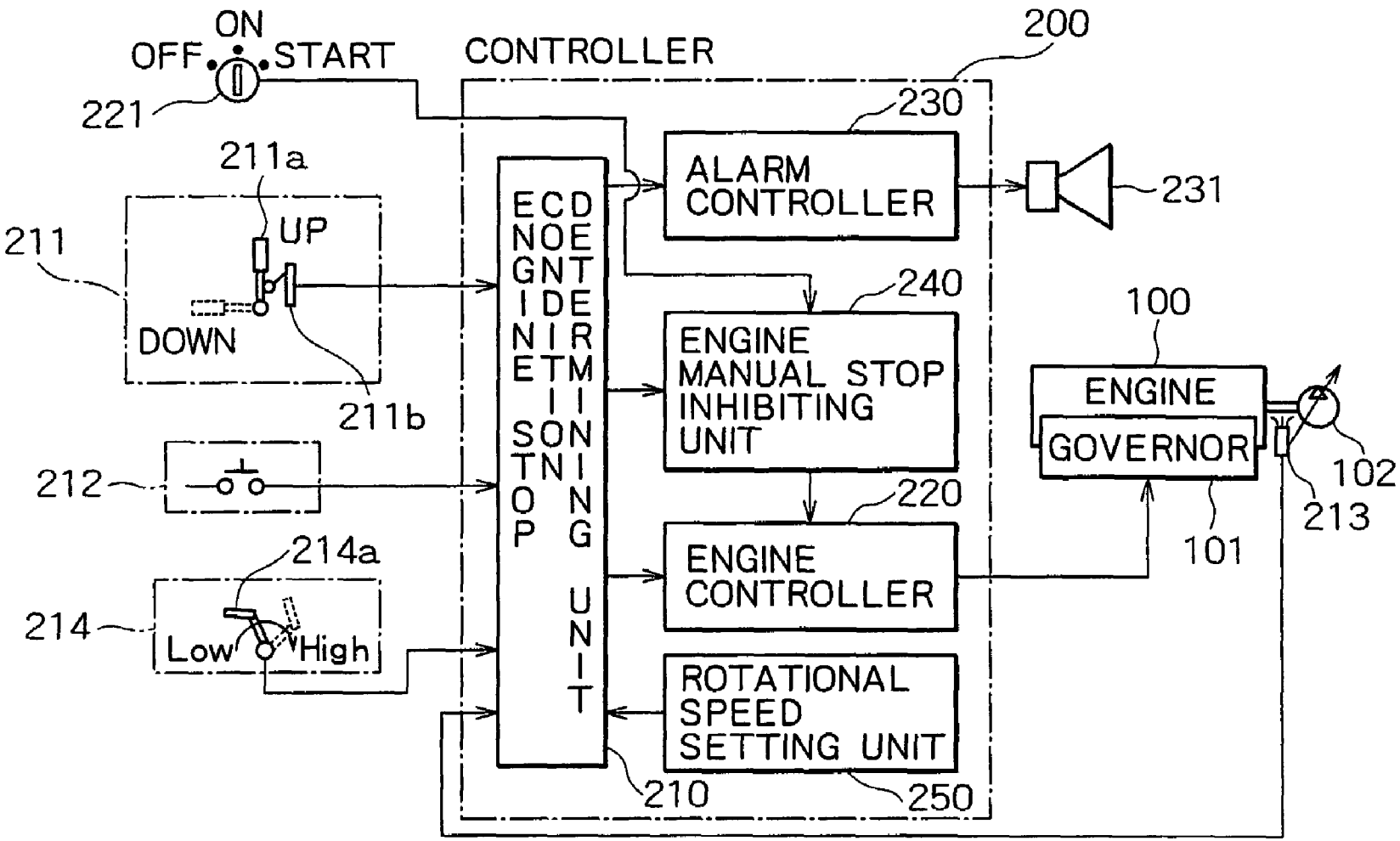
FIG. 1 is a functional block diagram of an engine control device of a hydraulic excavator according to a first embodiment of the present invention.

FIG. 1 is a functional block diagram of an engine control device of a hydraulic excavator according to a first embodiment of the present invention.

In FIG. 1, reference numeral 100 denotes an engine serving as a power source, and reference numeral 200 denotes a controller (corresponding to engine control means) adapted to carry out an engine control according to the present invention.

To the controller 200 are connected a governor 101, a gate lever device 211, a cancel switch 212, a rotation sensor (corresponding to engine rotational speed detecting means) 213, a throttle lever device 214, a key switch 221, an alarm buzzer (corresponding to notifying means and alarming means) 231, and the like.

The gate lever device 211 is provided in a gateway of the hydraulic excavator and opened/closed (up/down) when an operator gets on/off. The gate lever apparatus 211 is provided with a gate lever 211*a*, and a limit switch (corresponding to gate lever position detecting means) 211*b* for detecting the up/down of the gate lever 211*a*.

The cancel switch 212 is a switch used by the operator to intentionally cancel the automatic stop control of the engine 100. The cancel switch 212 is depressed if a work still continues after some standby period, for example.

The throttle lever device 214 is provided with a throttle lever (corresponding to engine rotational speed instructing means) 214*a* adapted to adjust the rotational speed of the engine 100. "High" and "Low" respectively denote a high speed rotation side and a low speed rotation side in FIG. 1.

The rotational speed of the engine 100 is controlled by the governor 101. An output shaft of the engine 100 is directly connected to a variable capacity type hydraulic pump 102. Work actuators (not shown) are operated by pressure oil supplied by the hydraulic pump 102.

The controller 200 is further provided with an engine stop condition determining unit 210, an engine controller 220, an alarm controller 230, an engine manual stop inhibiting unit 240, and a rotational speed setting unit 250.

The engine stop condition determining unit 210 determines whether the cancel switch 212 is off, the gate lever 211*a* of the gate lever device 211 is up, the limit switch 211*b* thereof is thus on, and the engine rotational speed detected by the rotation sensor 213 is equal to or lower than a predetermined engine stop rotational speed, and the unit 210 automatically stops (auto-stops) the engine 100 upon each condition being met.

The engine stop condition determining unit 210 then respectively supplies the engine controller 220, the alarm controller 230, and the engine manual stop inhibiting unit 240 with a condition-met signal or a condition-not-met signal.

Note that the engine stop rotational speed is predetermined in the rotational speed setting unit 250 as a safe rotational speed suitable for stopping the engine 100 and peripheral devices such as a turbine.

The engine controller 220 starts the engine 100 upon receiving an "ON" signal generated by an operation applied to the key switch 221, and stops the engine 100 upon receiving an "OFF" signal (key-off signal). The engine controller 220 controls an engine output based upon the amount of the operation applied to the throttle lever 214*a* of the throttle lever device 214 after the engine is started.

An instruction signal is output to the governor 101 for an engine operation control. In the first embodiment, the engine controller 220 further supplies the governor 101 with a stop instruction signal for the engine 100 upon receiving the condition-met signal as a result of determination by the engine stop condition determining unit 210. Consequently, the automatic stop control of the engine 100 is activated.

The alarm controller 230 sounds an alarm buzzer 231 upon receiving the condition-not-met signal as the determination result by the engine stop condition determining unit 210. Consequently, an alarm directed to the operator is generated in order to warn that the condition is not met, namely the present state does not allow a safe stop of the engine 100. Based upon the alarm, the operator realizes that the condition is not met for carrying out the automatic stop control according to the present embodiment. The operator is then prompted to take measures such as operating the throttle lever 214*a* to the "Low" side.

Upon receiving the condition-not-met signal from the engine stop control condition determining unit 210, the engine manual stop inhibiting unit 240 cuts off the key-off signal from the key switch 221 to the engine controller 220. The engine manual stop inhibiting unit 240 neglects the operation applied to the key switch 221 by the operator by cutting off the key-off signal to inhibit the engine 100 from being manually stopped. Consequently, even if the operator does not realize the alarm, and tries to carry out the key-off operation, the key will not be turned. Therefore, there is no fear a possible manual stop of the engine 100.

Figure 2:
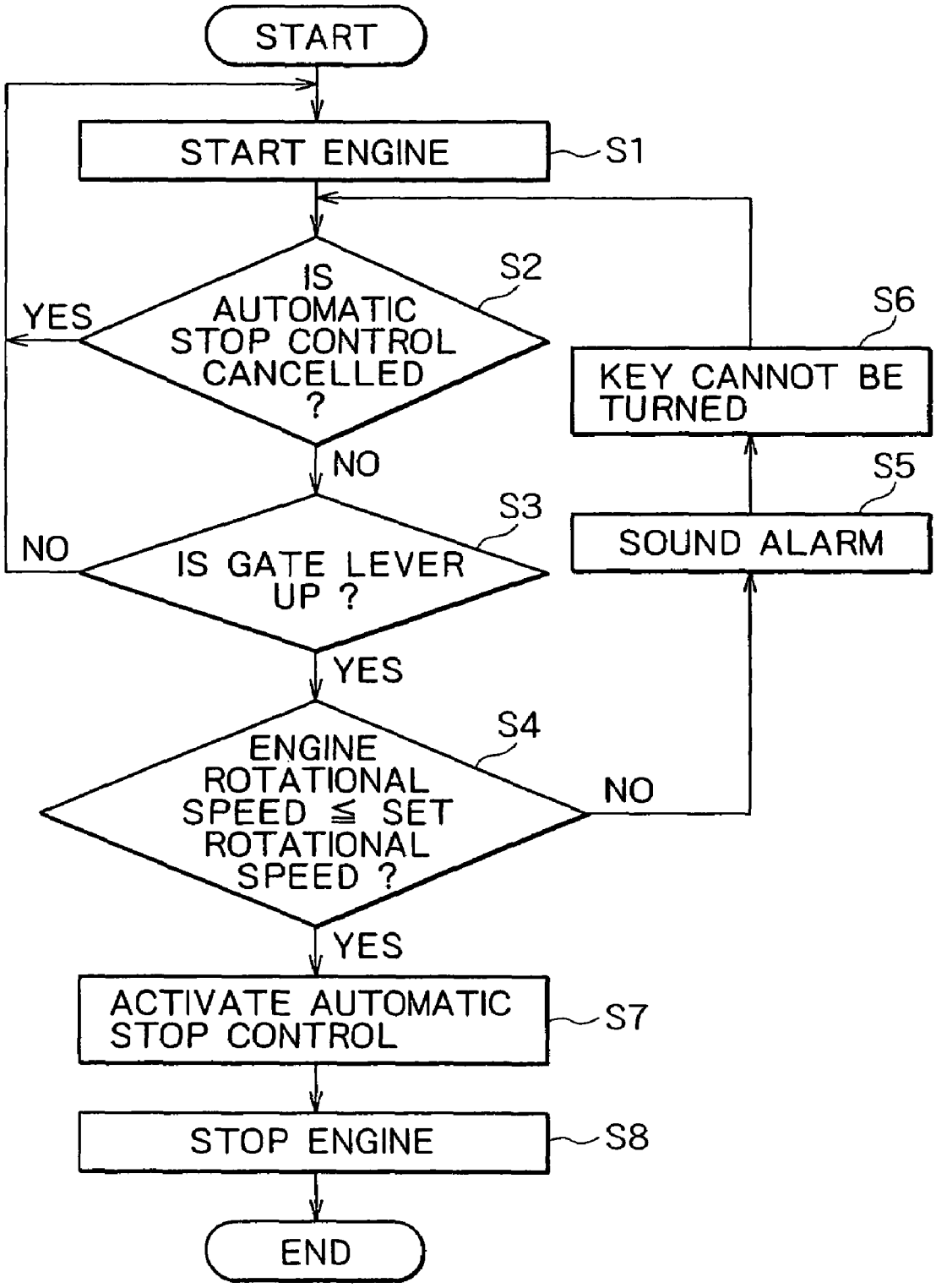
FIG. 2 is a flowchart showing an operation example of the engine control device according to the first embodiment.

FIG. 2 is a flowchart showing an operation example of the engine control device configured as described above, and a description will now be given with reference to FIG. 2.

If the operator first turns the key switch 221 to a "START" position, the engine controller 220 supplies a start signal to the governor 101 to start the engine 100 (Step S1).

On this occasion, if the limit switch 221*b* adapted to detect a position of the gate lever 211*a* is off, or a position of the throttle lever 214*a* is on the "High" side, the engine 100 cannot be started. Therefore, the operator is prompted by means of sounding the alarm buzzer 231 or the like to move the gate lever 211*a* to an up position, and to move the position of the throttle lever 214*a* to the "Low" side. If the gate lever 211*a* is at the up position, and the position of the throttle lever 214*a* is moved to the "Low" side, the condition-not-met signal is not supplied from the engine stop condition determining unit 210, and the engine manual stop inhibiting unit 240 interposing between the key switch 221 and the engine controller 220 is thus not activated. Consequently, the engine 100 is started by a key operation applied to the key switch 221. Note that as means to decelerate the engine rotational speed to the "Low" side, there is a deceleration switch 215 according to a third embodiment described later in addition to the throttle lever 214*a* (refer to FIG. 5).

The key switch 221 automatically returns to an "ON" position, and the operator turns the throttle lever 214*a* from the "Low" side to the "High" side while the key switch 221 is at the "ON" position. The engine controller 220 then outputs an acceleration signal to change a set value of the governor 101, thereby controlling the engine output.

The engine stop condition determining unit 210 then determines whether the operator has depressed the cancel switch 212 or not (Step S2). If the engine stop condition determining unit 210 determines that the cancel switch 212 is depressed, since the operator intends to prevent the automatic stop control from being activated as described above, and the processing flow returns to immediately before Step S1. The engine 100 then maintains running. On the other hand, if the engine stop condition determining unit 210 determines that the cancel switch 212 is not depressed, the processing flow advances to next Step S3.

The engine stop condition determining unit 210 then determines whether the gate lever 211*a* is up/down according to the "ON"/"OFF" signals of the limit switch 211*b* (Step S3). If the engine stop condition determining unit 210 determines that the gate lever 211*a* is not up on receiving the "OFF" signal from the limit switch 211*b*, the processing flow also returns immediately before Step S1. The engine 100 then maintains running.

On the other hand, if the automatic stop control is not cancelled, and the engine stop condition determining unit 210 determines that the gate lever 211*a* is up on receiving the "ON" signal from the limit switch 211*b*, the engine stop condition determining unit 210 determines whether the engine rotational speed detected by the rotation sensor 213 is equal to or lower than the predetermined engine stop rotational speed by the rotational speed setting unit 250 (Step S4).

Upon determining that the engine rotational speed is not equal to or lower than the pre-set engine stop rotational speed, the engine stop condition determining unit 210 supplies the alarm controller 230 with the condition-not-met signal. The alarm controller 230 then sounds the alarm buzzer 231 (Step S5).

Note that the gate lever device 211 usually determines that the operator is away from an operator's seat upon the gate lever 2 ha being up, and locks a hydraulic circuit thereby inhibiting operations applied to hydraulic actuators. According to the present embodiment, determination for the engine stop condition is made according to the signals output from the limit switch 211*b* provided on the gate lever 211.

The engine stop condition determining unit 210 then supplies the engine manual stop inhibiting unit 240 with the condition-not-met signal. The engine manual stop inhibiting unit 240 neglects the key-off operation by the operator while the condition is not met. As a result, the key cannot be turned, and the engine 100 thus will not be manually stopped (Step S6). The processing flow then returns immediately before Step S1, and the engine 100 thus maintains running.

On the other hand, upon determining that the engine rotational speed is equal to or lower than the pre-set engine stop rotational speed in Step S4, the engine stop condition determining unit 210 supplies the engine controller 220 with a stop instruction signal intended for the engine 100. As a result, the engine controller 220 enters an automatic stop control operation (Step S7), and the engine 100 thus automatically stops (Step S8).

As described above, according to the first embodiment, the automatic stop control for the engine 100 is activated according to the condition that the open state of the gate lever 211*a* is detected by the limit switch 211*b* of the gate lever device 211, and the condition that the engine rotational speed detected by the rotation sensor 213 is equal to or lower than the pre-set engine stop rotational speed. The engine 100 is thus stopped after reaching a low rotational speed equal to or lower than the engine stop rotational speed.

It is thus possible to prevent the construction machine provided with the automatic stop function from stopping while the engine 100 thereof is running at a high rotational speed, thereby eliminating engine troubles, and extending the life of the engine 100. Moreover, since the engine 100 is stopped while running at a low rotational speed equal to or lower than the set value, upon the engine 100 being equipped with a turbine supercharger, for example, there is no fear for possible troubles such as seizures of bearings used for the turbine. Further, after the engine 100 is stopped, since the throttle lever 214*a* is on the "Low" side, and the engine 100 is thus always started at a low rotational speed, the engine 100 is sufficiently lubricated. Therefore, there is no fear for possible oil film ruptures and the like.

Moreover, according to the first embodiment, the engine stop condition determining unit 210 is configured to determine whether the above condition is met based upon the engine rotational speed detected by the rotation sensor 213 used to detect the rotational speed of the engine 100. As a result, there is made a precise determination whether the automatic stop control for the engine 100 is activated or not based upon the actual engine rotational speed.

(b) Second Embodiment

Figure 3:
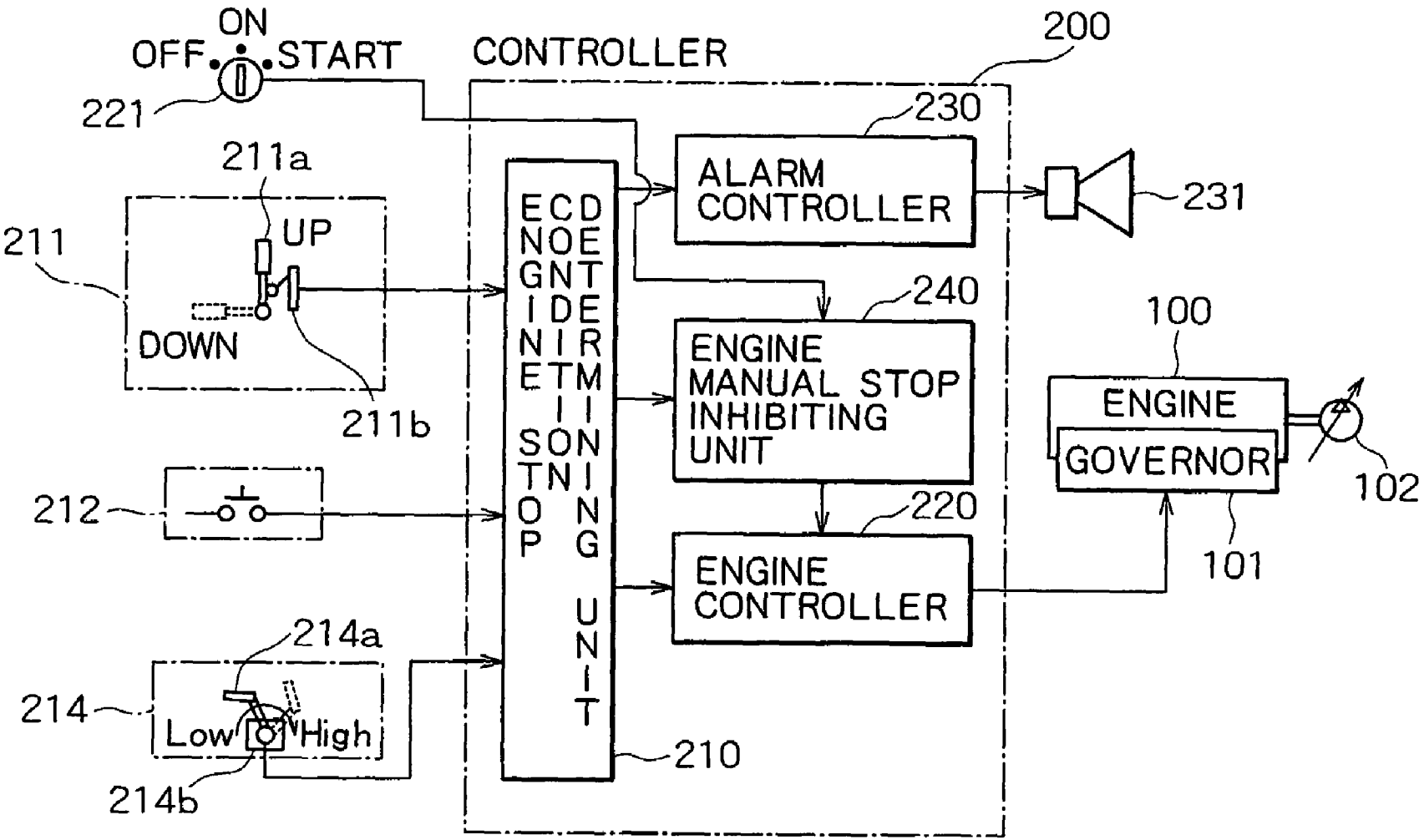
FIG. 3 is a functional block diagram of an engine control device of a hydraulic excavator according to a second embodiment of the present invention.

FIG. 3 is a functional block diagram of an engine control device according to a second embodiment of the present invention. Note that in the following description, the same components are denoted by the same numerals as of the first embodiment, and will be explained in no more details.

As shown in FIG. 3, the engine control device according to the second embodiment uses the throttle lever device 214 to substitute a function of the rotation sensor 213 according to the first embodiment.

The throttle lever device 214 is configured by the throttle lever (corresponding to the engine rotational speed instructing means) 214*a* and a throttle position detecting sensor (corresponding to an operation amount detecting sensor serving as the engine rotational speed detecting means) 214*b*.

The throttle position detecting sensor 214*b* is a potentiometer attached to a rotation shaft of the throttle lever 214*a*, for example. The throttle position detecting sensor 214*a* detects the operation amount of the throttle lever 214*a* by the operator.

The engine stop condition determining unit 210 then receives an operation amount signal from the throttle position detecting sensor 214*b* to determine whether the condition is met or not as in the first embodiment.

Figure 4:
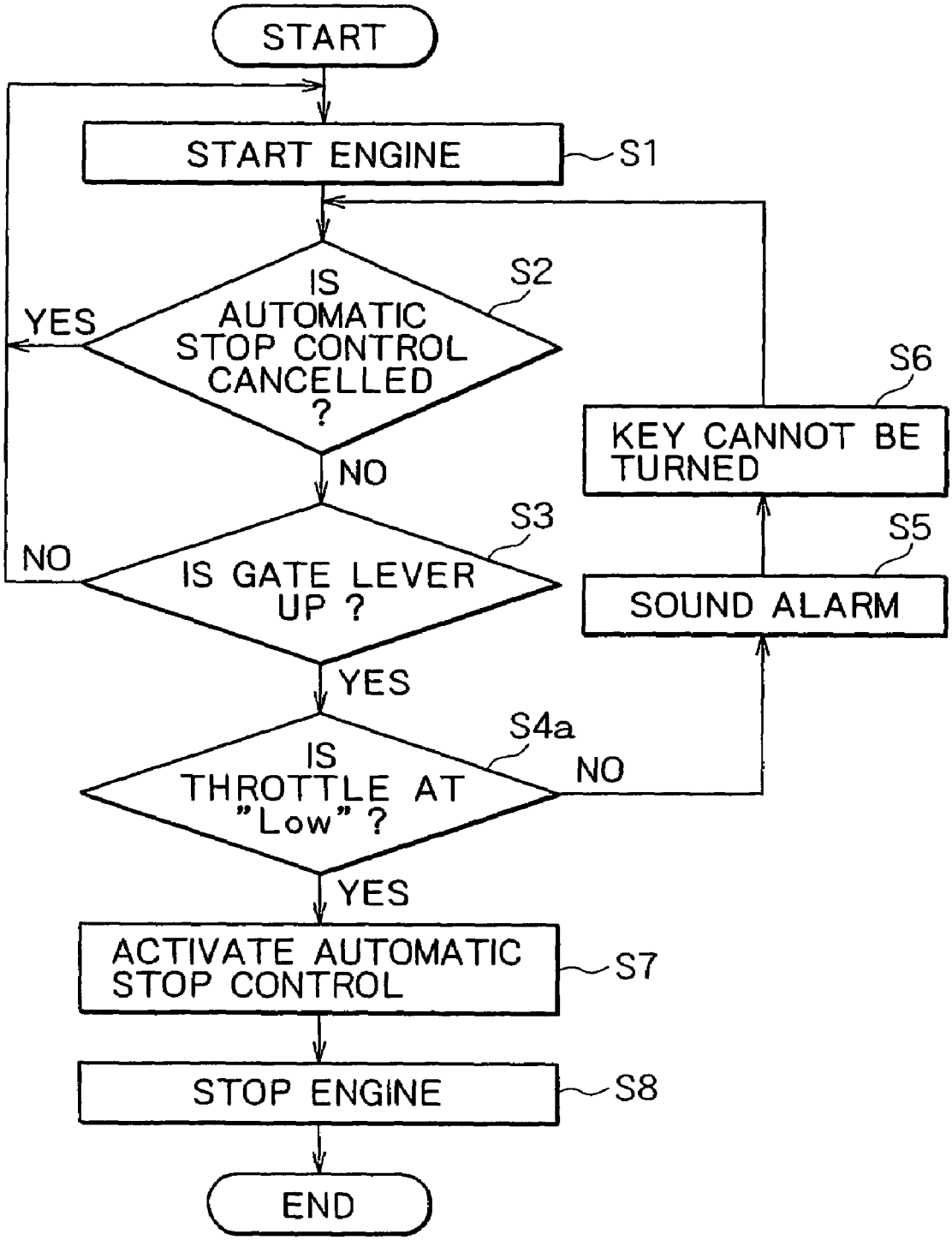
FIG. 4 is a flowchart showing an operation example of the engine control device according to the second embodiment.

FIG. 4 is a flowchart showing an operation example of the control device.

Steps S1 to S3, and S5 to S8 are similar to those in the first embodiment. However, in Step S4*a*, the engine stop condition determining unit 210 determines whether the operation amount of the throttle lever 214*a* detected by the throttle position detecting sensor 214*b* is on the "Low" side or not. Upon determining that the operation amount of the throttle lever 214*a* is not on the "Low" side, the engine stop condition determining unit 210 regards that the engine 100 is rotating at a high speed, and the processing flow advances to Step S5 to generate the alarm or the like. On the other hand, upon determining that an operation position of the throttle lever 214*a* detected by the throttle position detecting sensor 214*b* is on the "Low" side, the engine stop condition determining unit 210 determines that the engine 100 is running at a low speed, and the processing flow advances to Step S7 to cause the engine controller 220 to carry out the automatic stop control operation.

As described above, according to the second embodiment, the engine stop condition determining unit 210 determines whether the condition is met or not based upon the operation amount of the throttle lever 214*a* detected by the throttle position detecting sensor 214*b* of the throttle lever device 214. With this configuration, it is not necessary to detect the actual rotational speed of the engine 100, and the device configuration is simplified accordingly.

(c) Third Embodiment

Figure 5:
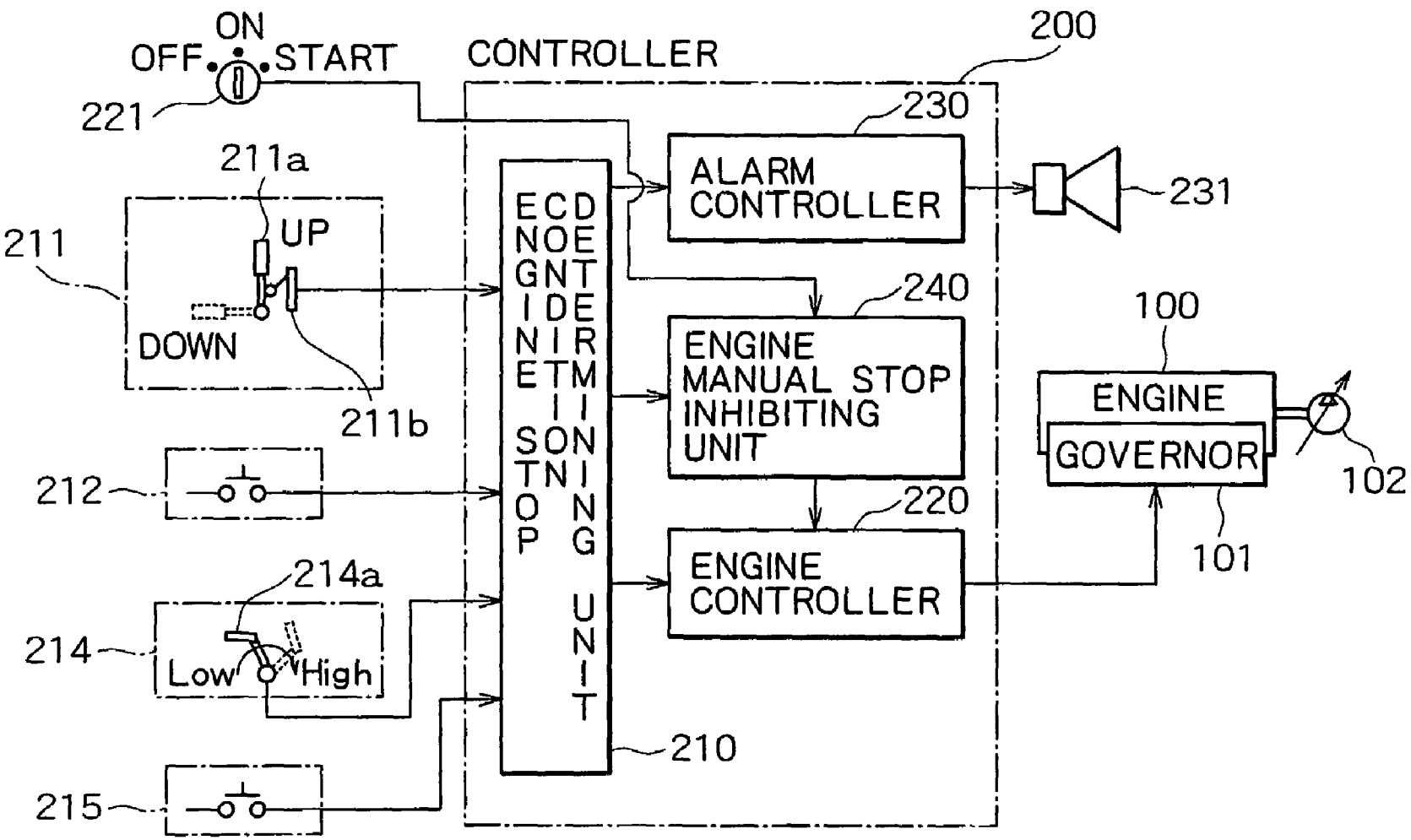
FIG. 5 is a functional block diagram of an engine control device of a hydraulic excavator according to a third embodiment of the present invention.

FIG. 5 is a functional block diagram of an engine control device according to the third embodiment of the present invention.

As shown in FIG. 5, the engine control device according to the third embodiment is not provided with either the rotation sensor 213 according to the first embodiment, or the throttle position detecting sensor 214*b* according to the second embodiment. In place of them, there is provided the deceleration switch (functioning as the engine rotational speed instructing means and the engine rotational speed detecting means) 215.

The deceleration switch 215 is a deceleration switch which outputs a deceleration signal, and is installed on a construction machine as an option. If the operator once touches the deceleration switch 215, the deceleration switch 215 outputs a signal which instructs the engine 100 to run at a rotational speed lower than a predetermined value, namely the predetermined engine stop rotational speed (low rotational speed) to the engine 100.

The deceleration switch 215 serves as a one-touch deceleration switch which is equipped on a small hydraulic excavator without having a so-called automatic deceleration control, which instructs an operation at a low rotational speed after a delay period elapsing from all operating levers are set to neutral positions, for example.

The engine stop condition determining unit 210 then receives a low speed rotation signal from the deceleration switch 215 to determine whether the condition is met as in the first and second embodiments. Namely, if the deceleration switch 215 is depressed, the engine 100 is compulsorily run at a low rotation. The engine stop condition determining unit 210 thus can determine whether the engine stop condition is met only according to the output of the low speed rotation signal.

Figure 6:
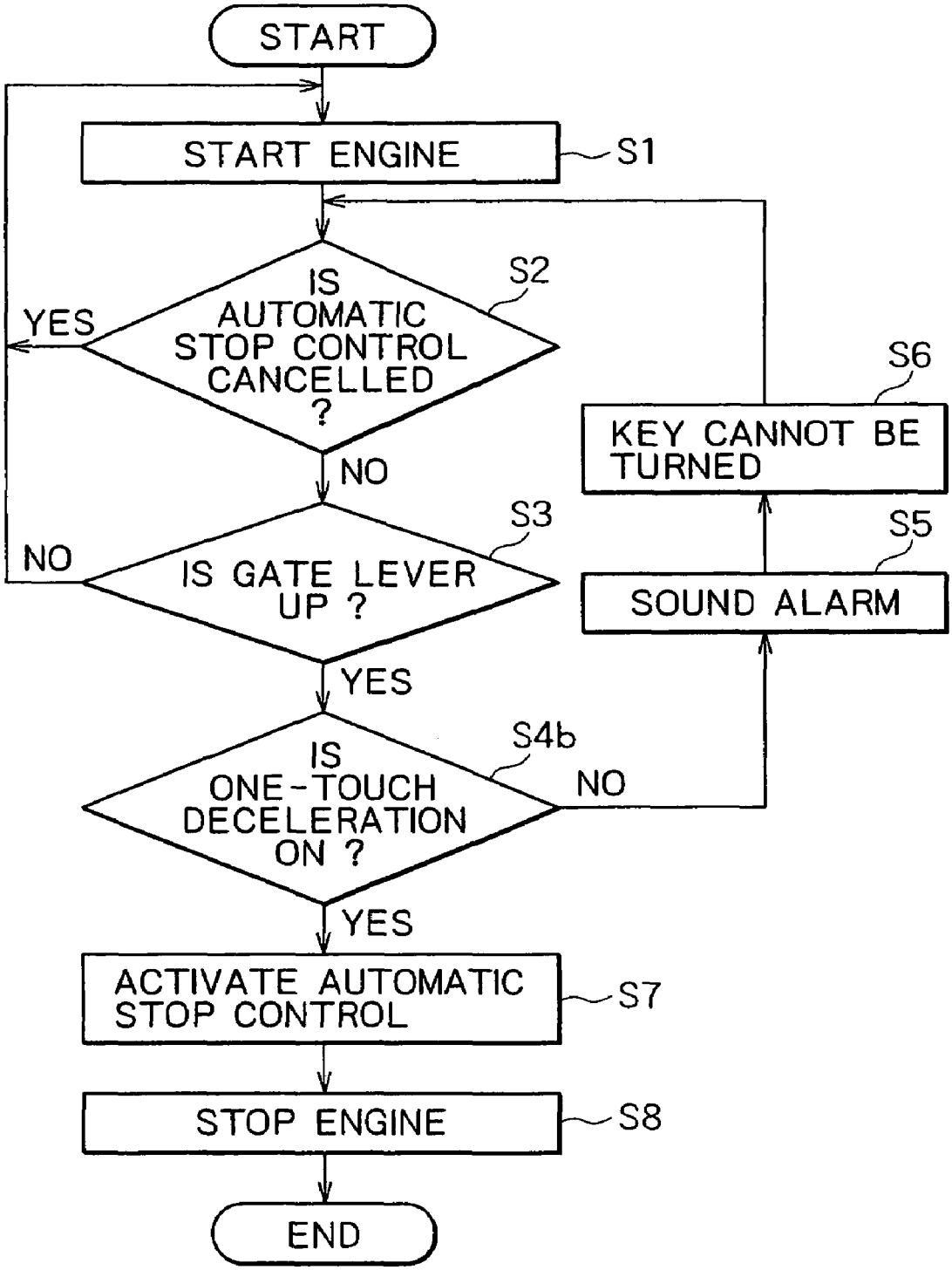
FIG. 6 is a flowchart showing an operation example of the engine control device according to the third embodiment.

FIG. 6 is a flowchart showing an operation example of the engine control device.

Steps S1 to S3, and S5 to S8 are similar to those in the first and second embodiments. However, in Step S4*b*, the engine stop condition determining unit 210 determines whether the deceleration switch 215 is depressed or not according to a presence of the low speed rotational signal from the deceleration switch 215. Upon determining that the deceleration switch 215 is not depressed, the engine stop condition determining unit 210 determines that the engine 100 is running at a high rotational speed, and the processing flow advances to Step S5. The engine stop condition determining unit 210 causes an alarm controller 230 to raise the alarm from the alarm buzzer 231 in Step S5, and causes the engine manual stop inhibiting unit 240 to inhibit a manual stop (Step S6). On the other hand, upon determining that the deceleration switch 215 is depressed, the engine stop condition determining unit 210 determines that the engine 100 is running at a low rotational speed, and the processing flow advances to Step S7. The engine stop condition determining unit 210 causes the engine controller 220 to carry out the automatic stop control operation in Step S7.

As described above, according to the third embodiment, the engine stop condition determining unit 210 detects the low speed rotation signal from the deceleration switch 215 intentionally depressed by the operator. The engine stop condition determining unit 210 thus can determine that the stop condition for the engine 100 is met or not. Therefore, according to the present embodiment, it is thus not necessary to wait until the determination whether the throttle lever 214*a* is operated to the "Low" side or not, which is necessary in the second embodiment, thereby quickly proceeding to the automatic stop control.

The first to third embodiments are configured such that upon the engine stop condition determining unit 210 determining that the engine 100 is running at a high rotational speed, the automatic stop control is not activated until the rotational speed reaches a low rotational speed equal to or lower than the predetermined value. However, the engine control device for a construction machine which includes the gate lever 211*a* for opening and closing the gateway for the operator, and makes the determination of a no operation state upon the gate lever 211*a* being opened, and automatically stops the engine 100, may include the engine rotational speed detecting means for detecting the rotational speed of the engine 100, and the alarming means for comparing the engine rotational speed detected by the engine rotational speed detecting means and the predetermined engine stop rotational speed with each other upon the gate lever 211*a* being opened, and raising the alarm upon the engine rotational speed being equal to or more than the engine stop rotational speed. According to this configuration, it is possible to notify the operator that at least the present state does not allow a safe stop of the engine 100.

As a result, the operator can take proper measures such as decelerating the rotational speed of the engine 100 to a low rotational speed.

Moreover, the first to third embodiments are configured such that the engine manual stop inhibiting unit 240 neglects the key operation by the operator after the alarm. The engine manual stop inhibiting unit 240 is not always necessary. Moreover, a light may be provided in place of the alarm by the alarm buzzer 231 or in addition to the alarm buzzer 231. Flashing of the light may certainly notify the operator of the condition being not met.

Moreover, the second and third embodiments may be applied in combination. In this case, the operator may simply operate either the throttle lever 214*a* or the deceleration switch 215, and convenience is thus brought about.

Moreover, the description is given of the engine control device of the hydraulic excavator as an example of the construction machines in the first to third embodiments. However, the application of the present invention is not limited to this example, and the present invention may be applied to an engine control device of other construction machines such as a wheel crane.

INDUSTRIAL APPLICABILITY

As described above, the present invention is useful for an engine control device for a construction machine such as a hydraulic excavator, and is especially preferable for an engine control device for a construction machine provided with an automatic stop function which automatically stops the engine.

What is claimed is:

1. An engine control device for a construction machine comprising an engine, engine rotational speed instructing means for instructing a rotational speed of said engine, a gate lever for opening and closing a gateway for an operator, a gate lever position detecting means for detecting an open or closed state of said gate lever, an engine rotational speed detecting means for detecting the rotational speed of said engine, and engine control means, wherein said engine control means is configured to automatically stop said engine when there is met a condition that the open state of said gate lever is detected by said gate lever position detecting means, and the rotation speed of said engine detected by said engine rotational speed detecting means is equal to or lower than a predetermined engine stop rotational speed.

2. The engine control device for the construction machine according to claim 1, wherein said engine rotational speed detecting means is a rotation sensor for directly detecting the rotational speed of said engine.

3. The engine control device for the construction machine according to claim 1, wherein a throttle lever operated by the operator is provided as said engine rotational speed instructing means, an operation amount detecting sensor for detecting an operation position of said throttle lever is provided as said engine rotational speed detecting means, and said engine control means is configured to obtain the engine rotational speed based upon the operation position of said throttle lever detected by said operation amount detecting sensor thereby determining whether the condition is met or not.

4. The engine control device for the construction machine according to claim 1, further comprising a deceleration switch for instructing a rotational speed equal to or lower than the engine stop rotational speed, said engine control means being configured to regard that said engine rotational speed detecting means detects the engine rotational speed equal to or lower than the engine stop rotational speed upon said deceleration switch being operated, and thus to determine that the condition is met.

5. The engine control device for the construction machine according to claim 1, further comprising notifying means for, upon the condition being not met, issuing a notice that the condition is not met.

6. The engine control device for the construction machine according to claim 5, wherein said engine control means is configured to wait for a rotational speed decelerating instruction by said engine rotational speed instructing means after the notice issued by said notifying means.

7. An engine control device for a construction machine comprising an engine, a gate lever for opening and closing a gateway for an operator, and engine rotational speed detecting means for detecting a rotational speed of said engine, further comprising:

alarming means for comparing the rotational speed detected by said engine rotational speed detecting means and a predetermined engine stop rotational speed with each other upon said gate lever being opened, and outputting an alarm upon the rotational speed being equal to or more than the engine stop rotational speed.

8. An engine control device for a construction machine comprising an engine, an deceleration switch adapted to output a signal instructing that a rotational speed of said engine is equal to or lower than a predetermined engine stop rotational speed, a gate lever for opening and closing a gateway for an operator, gate lever position detecting means for detecting an open or closed state of said gate lever, and engine control means, wherein said engine control means automatically stops said engine when there is met a condition that the open state of said gate lever is detected by said gate lever position detecting means, and that said deceleration switch is operated.

* * * * *